United States Patent [19]

Green

[11] 4,189,184

[45] Feb. 19, 1980

[54] ROTARY DRILLING AND EXTRACTING PROCESS

[76] Inventor: Harold F. Green, 100 Fir St., Room 21, Sherwood Park, Alberta, Canada, T8A 1Z7

[21] Appl. No.: 951,646

[22] Filed: Oct. 13, 1978

[51] Int. Cl.[2] ..... E21C 41/10

[52] U.S. Cl. ..... 299/8; 166/265; 166/272; 175/285

[58] Field of Search ..... 166/265, 267, 268, 272; 299/5, 17, 8; 175/285, 269.65

[56] References Cited

U.S. PATENT DOCUMENTS

| | | | |
|---|---|---|---|
| 2,450,223 | 9/1948 | Barbour | 175/285 |
| 2,595,979 | 5/1952 | Pevere et al. | 299/5 |
| 2,847,189 | 8/1958 | Shook | 175/285 |
| 3,472,553 | 10/1969 | Miller | 299/5 X |
| 3,951,457 | 4/1976 | Redford | 299/17 |

*Primary Examiner*—William F. Pate, III
*Attorney, Agent, or Firm*—Hirons, Rogers & Scott

[57] ABSTRACT

Process and apparatus is described for mining of subterranean carbonaceous deposits such as tar sands, in which the deposit is treated in situ with circulating high pressure jets of heated mining fluid comprising water in admixture with gaseous hydrocarbons, or carbon dioxide and the deposit is also subjected substantially simultaneously to mechanical grinding in the vicinity of application of the circulating jets, so as to free and grind the deposit and float the separated carbonaceous portion to the surface. The mining tool has an umbrella-like action, comprising a plurality of mining arms carrying jets and potatable mining teeth or cutters, the tool being rotatable down hole to mine the deposit, and the mining arms thereof being radially expandable below ground, so as to enlarge a pilot hole drilled initially, into a large production hole for large scale mining projects.

7 Claims, 5 Drawing Figures

ROTARY DRILLING AND EXTRACTING PROCESS

This invention relates to methods and apparatus for mining, and more particularly to novel methods and apparatus for combination hydraulic and simultaneous rotary mechanical mining in situ of solid or semi-solid subterranean carbonaceous deposits, for example bitumen, heavy oil and coal. One specific field to which the present invention relates is the mining of deposits to recover the values therefrom in situ. A specific application of the invention is the mining of mineral-bitumen deposits, e.g. tar sands and heavy oils, for extraction and separation of the oil values therefrom below ground, whilst leaving at least a major proportion of inorganic component of such deposits within the in situ cavity.

The most familiar example of mineral-bitumen deposits are the tar sands, located in parts of Northern Alberta, and referred to commonly as the Athabasca Tar Sands. These Athabasca Tar Sands are estimated to contain many billion barrels of crude oil reserves. Intensive studies and investigations are underway to develop suitable technology whereby oil can be extracted from tar sands economically, refined to useful petroleum products and transported to industrial markets.

The composition of the Athabasca Tar Sands is widely variable from location to location. The components of the tar sands include minerals, oil, water and gas. The components have been deposited at various geological times and under various geological conditions, to form in effect variable fine-to-coarse agglomerate particles of clay, silt and quartz sand, each individually surrounded by rings of thin films of connate water, leaving voids between their irregular shapes containing a dense thick tarry asphalt base oil, and gas, in varying amounts up to an average 20%.

The oil content of the tar sands, on a percent by volume basis, is quite variable, being generally less than about 25%. The oil generally has a high specific gravity, and a small water content. The oil becomes thinner progressively as it is heated. The balance of the composition is mainly mineral, and is predominantly uniform white quartz sand, the remainder being essentially clay fines with traces of associated minerals. The trace minerals are present at least in part as metal porphyrins, primarily vanadium porphyrin and nickel porphyrin, and sulphur. Some of these trace minerals can however form dangerous pollutants. Particularly dangerous are vanadium compounds, especially when found and processed in combination with other compounds and processes.

One commercial method which has been developed and used involves removing the tar sand deposit from below ground by open pit mining, and then conducting an extract process above ground to recover the oil from the associated inorganic components of the deposit. It is clearly undesirable to have to raise from underground deposit 100 units by weight of material when only about 10–20 units by weight is useful product. Open pit mining, in particular, entails the removal of large tracts of land from other surface uses for extended periods of time. Such surface operations are adversely effected by severe frosts encountered in the tar sands area, which vastly effect the cost of operations, labour required and life of equipment. The cost of returning the ground to useful condition, and the difficulties of compacting the replaced ground, are also very considerable.

Surface processing of mined tar sands, to separate the organic bitumen or oil from the inorganic content, has many attendant problems. The bitumen contains traces of minerals and rare earth elements. When the bitumen is processed above ground, for separation from sand, the minerals and rare earth elements, along with sulphur and traces of vanadium, form nuclei on which coke particles deposit, in subsequent distillation.

The resulting coke, although in theory a high carbon content material, is rendered practically worthless as a fuel because of its high corrosive mineral content. Burning of this coke gives effluents having high concentration of pollutants, causing prohibitive sulphur contents in stack gases and prohibitive breakdown of boilers. One of the minerals commonly found in the bitumen of the tar sands is vanadium, in various compound forms. Vanadium in combination with sulphur is a dangerous pollutant. The coke product of such a process must therefore be discarded, or burnt in limited quantities in small supplementary equipment, or used as fill.

Other previously proposed and used tar sand extraction and separation processes involve hot or cold water washing to separate the organic components from the inorganic components. One such process is an in situ method, generally known as the steam-drive method, and sets out to make the oil flow without moving the sand. An injection well and adjacent production wells are drilled in a 5 spot arrangement into the tar sand deposit, and fractures of the tar sand are shock induced between the wells. Then high pressure steam and aqueous alkaline solutions are injected into the injection well, and reverse, so as to emulsify the bitumen and cause it to float for eventual separation from the sand, and the liquid aqueous emulsion is recovered from alternate adjacent production wells. Then the bitumen must be separated from the aqueous emulsion.

Such processes, due to temperatures and pressures used, form impervious coke enveloped paths limiting any further diameter expansion, and hence limit production.

The use of high pressures below ground in the steam drive process effectively limits its applicability to areas where the overburden is of substantial depth, such as 500 feet or greater, because of the risk of blow-outs to the surface. In addition, it tends to accelerate undesirable carbonization blockage.

In total, in situ separation processes, if efficient, have the substantial advantage that the non-useful, sand component of the tar sands does not have to be raised to the surface and subsequently replaced. Only the efficiencies of various methods can be questioned.

The present invention provides, in one embodiment, a novel process for in situ separation of oil and sand from tar sand deposits, in which a high proportion of the separated sand is left down hole, and not brought to the surface at all. As much as 95% plus of the bitumen in the deposit can be separated and extracted to the surface. The process of the invention can be operated with a minimum of disturbance to the overburden and surface ground layers. The process very materially reduces the environmental problems experienced with previously proposed and operated tar sands extraction processes. The invention also provides a novel mining apparatus for in situ extraction and separation of oil or bitumen from tar sand deposits, and various other mining operations as described herein, without putting men underground in toxic areas, requiring ventilation for human safety, and requiring the forcing of human environmental air undergrood which can induce possibly explosive atmospheres.

Thus according to one aspect of the present invention, there is provided a process for the mining of subterranean carbonaceous deposits, which comprises:

treating the carbonaceous deposit in situ with circulating high pressure jets of heated mining fluid comprising water in admixture with normally gaseous hydrocarbons, the temperature difference between the in situ deposit and the mining fluid immediately prior to issue from the jets being at least 160° F., and subjecting the deposit to mechanical grinding in the vicinity of application of said circulating jets, so as to reduce the treated deposits to finely divided form;

upwardly displacing carbonaceous components of the finely divided deposits so formed, and mechanically agitating the aqueous slurry of residual mining fluid remaining underground, to cause downward settling of other components of the finely divided deposits so formed.

According to another aspect of the present invention, there is provided a process for in situ extraction of bitumen values from subterranean tar sand deposits, which comprises:

drilling a pilot hole of relatively narrow diameter from the ground surface, through the overburden and the tar sand deposit and a distance of 2–2½ times the thickness of the tar sand deposit into the sub-tar sand formation located beneath the tar sand deposit;

enlarging the pilot hole below the tar sand formation to form a sub-tar sand cavern and extracting the mined materials from said sub-tar sand tar cavern to the ground surface through said pilot hole;

filling the sub-tar sand cavern with aqueous liquid;

enlarging the pilot hole radially in the tar sand deposit by treating the tar sand deposit with circulating high pressure jets of heated mining fluid comprising a mixture of water and normally gaseous hydrocarbons, the temperature difference between the in situ deposit and the mining fluid immediately prior to issue from the jets being at least 160° F., to cause breakup of the tar sand deposit and interaction of the bitumen portion of said deposit with gases of the mining fluid, and to form a tar sand cavern;

agitating the liquid slurry of tar sand and mining fluid formed in the tar sand cavern to wash and cause downward settling of the sand component of the tar sand;

and upwardly displacing the separated oil component to the ground surface.

The process of the invention is useful for tertiary recovery of heavy and light oils, from known depleted fields, as well as from tar sand deposits and the like. In the conventional field, usually only 25% to 40% of the oil in an average field is recoverable by conventional means. The present invention provides a means by which the industry may embark upon further recovery of oil values from conventional areas, even after primary and secondary recovery, involving water injections and the like, has been completed.

The present invention provides a method and apparatus for recovering additional quantities of oil from conventionally drilled reservoirs. According to the invention, new production holes are bored adjacent to abandoned wells, and oil extracted by the combined hydraulic/mechanical bottom hole enlarging mining process as described herein for use with tar sand deposits.

In the process of the present invention as applied to tar sand mining, the bitumen portion of the tar sands is brought to the surface, along with varying, minor proportions of sand tailings. This material, which is obtained in the form of a water/oil emulsion, is readily processed at the surface in known, conventional hydrocarbon separation, cracking and refining processes and apparatus. Most of the remaining inorganic constituents such as rock, shale, sand, gravel and the like, remain below ground. To the extent that such potentially pollutant material is contained in the bitumen/oil fractions, these are readily dealt with in the conventional surface processing equipments of refining and cracking, according to well established refinery procedures.

The conditions of treatment of the tar sand deposit in situ according to the process of the present invention are chosen in combination to give a maximum recovery of the bitumen content, together with fast and efficient separation of the bitumen content from the inorganic, mainly sand, components of the tar sands. These conditions involve the use of combination hydraulic and mechanical mining, whereby the tar sand deposit is treated with a mechanical grinding action and a high velocity, high pressure hydraulic mining fluid, the fluid containing normally gaseous hydrocarbons which, on contacting the tar sands at high pressures, interact with the bitumen portion of the tar sand to reduce its specific gravity, and cause frothing thereof, effectively forming a frothed, bitumen-rich aqueous bouyant emulsion. This emulsion is lighter than the aqueous phase formed by the rest of the mining fluid. As the mining process continues, a hole or cavern is formed in the tar sand deposit, which gradually fills with the aqueous liquid. The separated sand sinks through the aqueous "pond" formed in the cavern, and is subjected to agitation therein by the mining tool and associated structure. This agitation has a ball milling effect upon the sand, thoroughly polishing it so as to release oil skin from the sand and thoroughly to wash the sand. This polishing effect can be enhanced by maintaining aqueous mining fluid pH in the alkaline range. As a result, clean sand sinks to the bottom of the cavern so formed, with the bitumen component due to its gas induced bouyancy rising to the surface.

A preferred method of conducting the process of the present invention is to mine the cavern in the tar sand layer from bottom to top of the deposit, using a rotating mining tool having arms with cutters and jets thereon, the arms extending radially outwardly and downwardly from a central shaft. As a result, the tool cuts an inverted conical shape in the deposit, the centre of the cone being an aperture to the ground surface. Hot fluid aqueous upward return flow applied to the central aperture, to float lighter material, i.e. the mined, frothed bitumen/water emulsion up to the surface.

The drilling motion of the cone upwardly causes centrifuging aiding separation while at the same time the volume of the annular slowly vertically rising return water to surface promotes a vertical movement up the frustrum of the cone, whereas the four arms in path at 90° permit a wide space for non-bouyant separated material to slide downwardly between spokes, so that the majority of the sand by virtue of being non-bouyant and wetted and slippery slides down the frustrum of the cone to enter the pool at its ascending base.

The Athabaska Tar Sand deposits are commonly found below an overburden, which varies in depth from location to location. At places, the overburden has been removed by glacial drift. Elsewhere the overburden has a depth of up to about 2,100 feet. Certain deposits in the Bakersfield, California region, have 1000 feet thick tar sand layer. The composition of the overburden of the Athabaska Tar Sands generally comprises shales, sands and gravels, in various amounts. The process of the present invention can be operated in the presence of overburdens of depths from about 20 feet to about 2100 feet.

One problem which an in situ tar sand extraction process has to overcome, especially one using an aqueous extraction medium, is the factor of swell. When treated with water under conditions of shear, the sand portion of the tar sand increases in volume by a factor of from about 2 to about 2½ times an average. The extraction of the bitumen content and its removal above ground does not provide sufficient extra volume below ground to allow for this volume expansion. One feature of the process of the present invention is the provision of a cavern below the tar sand deposit into which a major proportion of the separated sand will settle, thereby allowing for this volume expansion factor.

A first step in the extraction process of the present invention is the rotary drilling of a pilot hole, from the ground surface, through the overburden, through the tar sand deposit and down into the sub-tar sand formation located beneath the tar sand deposit. If circulation is lost at any point in transverse described above, drilling is immediately stopped, tools withdrawn, casing run to bottom, perforated at last circulation point and suitable drilling muds or cement are fed through the perforations, for example by the Haliburton method, with fast set fluids, until gauges indicate the formation is permanently sealed. Then drilling is resumed. Whilst this pilot hole is of very small diameter in comparison with the diameter of the subterranean caverns subsequently to be mined, it can nevertheless be of substantial diameter, such as 2–20 feet. The diameter is selected with a view to overburden depth, desired diameter extension, and a economic balance between maximum pay zone, expansion and number of holes to be drilled, and accommodating the passage therethrough of the mining tools to be used in the subsequent process stages. Thus the size of the pilot hole should have regard to the planned size of the expanded hole subsequently to be drilled in the tar sand deposit for production purposes, which will in part determine production rates. The thickness and consistency of the overburden layer is also significant in this respect. Normally, a well casing is inserted in the pilot hole for the depth of the overburden, to prevent washout of overburden from the solvent action of the liquids returning to the surface therethrough. It is important that steps be taken to prevent clay, shale or the like from the overburden from mixing with the bitumen being extracted.

The characteristics of the various subterranean formations through which the drilling passes as it proceeds downwardly, should be recorded carefully in a well log, to gather information useful in adjusting subsequent process conditions.

The pilot hole is continued to the base of the tar sand layer, with note being taken of the depth of this layer and its physical characteristics. As the pilot hole is drilled, the extracted material is brought to the surface in the conventional manner and put to one side, for later replacement.

There is normally, but not invariably, found below the tar sand layer a stratum of base rock of variable thickness, underneath which is sub-base rock strata which may be of clay, sand, limestone etc. When the pilot hole is drilled to the base rock layer, the pilot hole is cased to that level by continuing a slightly smaller diameter well casing from the surface to the top of the base rock layer. Drilling of the pilot hole is continued through the base rock layer, and into the sub-base rock strata. It is preferred to continue the pilot hole a distance into the sub-base rock layer which is not less than the depth of the tar sand layer, and most preferably from about 2 to 2½ times the depth of the tar sand layer. The clean, pollution-free cuttings removed from the base rock and sub-base rock strata are extracted to the surface and put to one side, for later back filling of the bitumen area, with settled, clean sand, also devoid of pollutants, contained in the oil.

When this drilling of the pilot hole has been completed to the necessary depth, the standard rotary drilling tools are taken apart and racked at the surface. The pilot hole may if desired be swabbed and tested with clean water for leaks, which if found are sealed with commercial sealing mud.

The next step in the process of the present invention is the radial and vertical enlargement of the pilot hole in the sub-base rock strata, to form the sub-tar sand cavern. The sub-tar sand cavern is formed by the use of the novel radially expandable mining tool described in more detail hereinafter. In essence, the tool is a combined mechanical and hydraulic mining tool, equipped with rotating mining teeth and hydraulic jet outlets near its radial extremities.

Where necessary, a drill bushing may be installed in the cement cap on a top bearing. Next the novel mining or hole expanding tool is mounted on the end of the kelly and lowered to the bottom of the hole. The hole expanding tool includes a fluid actuated cylinder and piston arrangement connected by a drill string to a source of fluid pressure above ground, and a plurality of articulated mining arms, typically four in number, having an umbrella-like action, pivotally connected at their lower end to the piston so as to expand and contract radially as the piston is raised and lowered in response to fluid pressure in the cylinder. The articulated mining arms are connected to a source of mining fluid located above ground, and are provided with high pressure outlet jets and mechanical rotating mining teeth along their upper surfaces, for upward or raise drilling. The jets and teeth effect a combination of hydraulic and mechanical mining.

The hole expanding tool is thus lowered through the pilot hole, and its radially contracted position, to the bottom portion of the pilot hole in the sub-base rock layer. Rotation of the mining tool, supply of mining fluid to the jets therein and gradual radial expansion of the tool by supply of fluid pressure to the fluid actuated cylinder then commences, so that the sub-base rock layer or shale, or salt beds are mined and the hole expanded, until the arms making an angle of about 60° for example, with the vertical. The mining fluid is supplied to the top mining arm interiors under high pressures, of the order of 1000–5000 psi, so that it issues at high speed from the jets. The jets are directed rearwardly and upwardly with respect to the rotation of the tool, so as to provide rotational thrust thereto, reducing by ½ to ¼ the torque bending moment on the kelly and mining arms. Then the mining tool is gradually raised, whilst continuing the rotation of the tool in the radially extended position and supply of high pressure, heated mining fluid thereto, by raising of the drill string from above ground draw works. This continues until the mining tool comes into the proximity of the base rock layer, when the excavating of the sub-base rock cavern is complete.

The material mined from the sub-base rock cavern in the process of the present invention is raised to the ground surface and put to one side, for later return to the ground when the tar sand layer has been mined. The raising of the mined material is accomplished hydraulically, the supply of mining fluid to the rotary hole enlarging tool under high pressure forcing the material to the ground by simple fluid displacement, up the kelly tube or drill string which extends down the pilot hole.

The mining fluid used for enlarging and excavating the sub-base rock cavern is aqueous, most suitably water.

After the sub-base rock cavern has been fully excavated in this manner, the mining tool is collapsed to its radially contracted position, by release of fluid pressure from the cylinder, and the cavern is filled, to the base of the base rock layer, with water. If, however, during the excavation of the sub-base cavern, porous zones, underground streams and the like are encountered, it is advantageous to seal these until abandonment under 5000 psi is completed, at the termination of the process. This can be accomplished by applying drilling muds, such as sealing "Baroids" of suitable consistency, or any of the other special purpose fluids available on the market for such purposes, squeezing them into the appropriate zone to effect sealing, by known techniques such as the Haliburton system or other.

It will be appreciated that the precise method adopted for the formation of the sub-tar sand layer cavern is not critical to the operation of the process of the invention, provided it is of sufficient size to accommodate the expanded volumes of materials obtained from the subsequent tar sand extraction process, and is located below the tar sand layer to be mined, and communicates therewith. It is preferred to drill the sub-tar sand layer cavern by the process outlined above, using the same apparatus as will subsequently be used to mine the tar sand cavern and cause separation of the bitumen from the tar sand down hole.

In the next stage of the process, inner casing is removed from the hole and the tar sand is excavated, by enlarging the pilot hole in the tar sand layer radially and vertically by processes similar to those described above, for drilling the sub-tar sand layer.

Next, the expandable mining tool, mounted on the end of the kelly, and positioned at the bottom of the tar sand layer. It is positioned in the pilot hole in its radially contracted position, and then rotation thereof is commenced, with supply of high pressure mining fluid to the jets in the articulated mining arms of the hole enlarging or mining tool. Fluid pressure is supplied to the cylinder, so as to raise the piston and cause gradual radial extension of the mining arms, as they are rotated and supplied with mining fluid. By a combination of hydraulic and mechanical mining, as the tool rotates, the mining tool enlarges the pilot hole at the base of the tar sand layer, until the mining tool reaches its full radial extension. The mining of the tar sand is continued from this point, by gradual upward movement of the rotating mining tool and its associated structure, from power means located at the surface, with the mining tool in its fully radially expanded position. This drawing upward continues until the upper mining portions of the mining tool reach the top of the tar sand layer and the bottom of the overburden. Then the mining is stopped, to ensure that clay and the like material from the overburden is not mined and mixed with the bitumen being extracted from the tar sand layer by the process of the invention. The depth of the overburden and thickness of the tar sand layer, and hence the position of the mining tool when rotation thereof and supply of hydraulic mining liquid thereto should cease, are readily determined from the records kept during the initial drilling of the pilot hole.

In this process of mining the tar sand layer, the tar sand is subjected to both mechanical mining, caused by rotating mining teeth, such as Hughes saddle gear cutters, located on the upper surfaces of the radially extended arms of the rotating mining tool, and hydraulic mining by being subjected to high pressure jets of mining fluid. The mining fluid which is used is a mixture of water and normally gaseous hydrocarbons, such as natural gas or $CO_2$. Preferably, the mining fluid is made slightly alkaline, pH 7.5–9.5, by addition thereto of a suitable alkali such as caustic soda. This serves to accelerate the down hole separation process of the bitumen from the sand, by enhancing the emulsification abilities of the mining fluid on the bitumen. The mining fluid is used at elevated temperatures, normally between 150° F. and 200° F. The use of such elevated temperatures assists in the separation of the tar sand deposit from its geological formation, and in separation of the bitumen from the sand content. Such high temperatures are used again to offset the 8.1 specific heat ratio of bitumen to water plus the cooling effect occasioned by the expansion of the gas as it is emitted under pressure through the jets. The viscosity of the bitumen is also reduced by raising its temperature, and emulsification of the bitumen in the dilute aqueous alkali is promoted. The actual temperature of the mining fluid which is used should be adjusted, in combination with the drilling speed, rate of extraction, and shearing strength of the deposit, so that the temperature of the bitumen water emulsion issuing to the surface through the cased hole in the overburden is at least 70° F. for ease of surface processing of the bitumen. The gas content of the drilling fluid, which is volume cut and adjusted to prevent drop in processing efficiency, issues from the jets on the mining arms, forming a gas envelope (as in underwater flame cutting) thereby greatly accelerating the rate of flow of the liquid and turbulating the flow from the jet to the deposit being mined. Natural gas is available from tar sand deposits themselves and can be used to supplement that used in the mining fluid. In some instances, economic factors may favour the use of carbon dioxide instead of methane.

Mechanical pressure exerted on the mining tool, normally in a generally upwardly direction, against the face of the bitumen deposit, forces the rotating mining teeth into the deposit. These mining teeth grind the deposit, destroying the structure of the tar sand particles, to promote emulsification of the bitumen with the warm alkaline fluid. The high pressure, high velocity mining fluid impinging upon the oil sand particles causes frothing of the bitumen/oil, forming a forthed bitumen/oil-rich aqueous emulsion which is lighter than water. Hence the frothed bitumen/oil emulsion floats, moving upwardly along the mining tool, induced to enter the main flow stream and eventually to the ground surface. The sand component of the tar sand deposit and the remainder of the aqueous drilling fluid moves downwardly over the mining booms, serving to wash them as they rotate.

The sand separated from this frothed bitumen/oil remains contaminated with an oil skin which it is desirable to remove. This contaminated sand is effectively polished by the rotating mining tool down hole in the pool of alkaline water accumulating and gradually filling the hole. By this agitation, an oil rich aqueous emulsion of bitumen is formed, floating as a layer on the surface of the aqueous effervescing pond, and gradually rising to the surface as more mining fluid is introduced. The sand is substantially totally freed of bitumen by this process, the polished sand sinking to the bottom of the tar sand cavern, and down into the sub-base rock cavern, displacing water therefrom as it does so.

The down hole separation of the process of the present invention can thus be considered as a multi-stage separation process. In a first stage, the tar sand deposit is subjected to warm mining fluid, containing natural gas, and preferably alkaline under high pressure and with mechanical action, to free it from the deposit, grind it and have the bitumen part subjected to the action of the natural gas, forming a frothed emulsion thereof. A subsequent stage involves (1) separation by sand washing and (2) separation by a type of "ball mill cleaning" as the sand settles in the rotating water pond. Oil froth flotation occurs as oil froth rises in the fluid pond and is forced upward through the annulus between the kelly and the bore hole to the surface, at the same time effecting a degree of lubrication of the mechanism and cutter. Subsequently an oil emulsion in water floats upwardly and is received at the surface.

Individual conditions of the bitumen deposit mining process according to the present invention are adjusted during the conducting of the process, so as to achieve the most efficient and rapid separation down hole, and recovery of bitumen at the surface. Thus, the pressure at which the mining fluid is supplied, and the speed at which the mining tool is rotated and drawn upwardly, as well as the alkalinity of the mining fluid and the temperature at which the mining fluid is supplied, will be quite widely variable, and may need adjustment on site according to varying conditions experienced. The optimum combination of such conditions will depend to some extent upon the nature of the tar sand deposit at the location at which it is being mined, its thickness, composition, compressive strength, depth, and the like. However, these are operating adjustments and lie within the skill of the mining engineers in the field.

When using a screening apparatus at the surface to separate the oil emulsion from the aqueous portion containing sand and clay, it is important to ensure that the temperature of the liquids striking the screen is 70° F. or lower, to prevent plugging. Thus if the liquid issuing from down hole is too hot or about 70° F., there is a risk that the heavy oil will become tacky and will plug the screen and necessitate shutting down of the process.

The oil values thus recovered are conveniently collected at the surface in a mobile surface separator where the aqueous portion is recovered, along with any sand and clay fines which have been removed with the oil emulsion, and returned down the hole. The trace minerals which would otherwise cause pollution problems are left down hole in the aqueous portion, or returned down hole with the water and fines which are separated and returned from the surface separator. Any pollution causing minerals in the bitumen/oil phase are removed before refining, according to known procedures.

The process of the invention can be operated on a large scale, enlarging the cavern in the tar sand layer to a diameter of from 10 to 300 yards. For example, when the cavern has a diameter of about 25 yards, and the tar sand deposit has a depth of 240 feet, about 19,500 cubic yards of tar sand are treated in one hole by the process of the invention. On average, the tar sand yields about 1 barrel of bitumen per cubic yard, so that a single hole can produce 19,500 barrels of bitumen or oil by the process of the invention.

The process can be operated in the presence or absence of an overburden overlying the tar sand deposit. It will be appreciated that heavy, massive equipment has to be provided on the ground surface overlying the location to be drilled and excavated. When a "shell" or cap rock is not present, to support the weight of the overburden and surface located mining equipment, during the processing and refilling cycle of the process of the invention, a large diameter surface cavity can be bored in the bottom of the overburden and then poured with concrete to form a support dome.

The surface operations associated with the process include initial levelling and dyking of the surface area immediately surrounding the location of the pilot hole. Suitably surface terrain in a unit rectangular area is bulldozed to a depth of 2–3 feet to each side and rearwardly. This forms dykes suitable for containment of pilot hole cuttings and sub-tar sand cavern cuttings, for a temporary period, until they are replaced down the bore hole at the conclusion of the process, of each hole, and becomes a process of drilling and expanding a new hole and simultaneously filling an exhausted hole.

The levelled and dyked area is suitably sized to accommodate several oil separation units, to which the liquid extracted bitumen is fed, as well as to accommodate the necessary surface power means and drilling rig components.

At the conclusion of the process, the hole is left sealed, to prevent the escape to the atmosphere of gaseous hydrocarbons migrating from down hole.

A feature of the preferred process of the invention is that the process can be repeated radially at successive locations of the tar sand deposit. The surface equipment can be radially and linearly mobile, so that, one drilling and excavation of one tar sand hole is complete, and all the tar sand therefrom treated and bitumen extracted, the equipment can be rotated to the next, adjacent location for drilling of an adjacent production hole. Whilst the new hole is drilled and brought into production, the exhausted hole is refilled. In this manner, a large area of tar sand deposit can be mined by means of successive boring, bringing into production and then refilling of production holes according to the process of the present invention. When single or double radial holes are worked out and abandoned, the machine is backed up to a successive location and the operation is repeated. Suitably, holes are drilled in pairs, two at a time, to balance out the torques applied to the down hole driven apparatus. After the machine drills a standard rotary drilled pilot hole in each new radial location or pair of holes, the standard rotary tools are removed and broken down, and the hole expanding string is assembled.

The process and apparatus of the present invention are illustrated by way of example in the accompanying drawings, in which.

In the drawings, like reference numerals indicate like parts.

Figure 1:
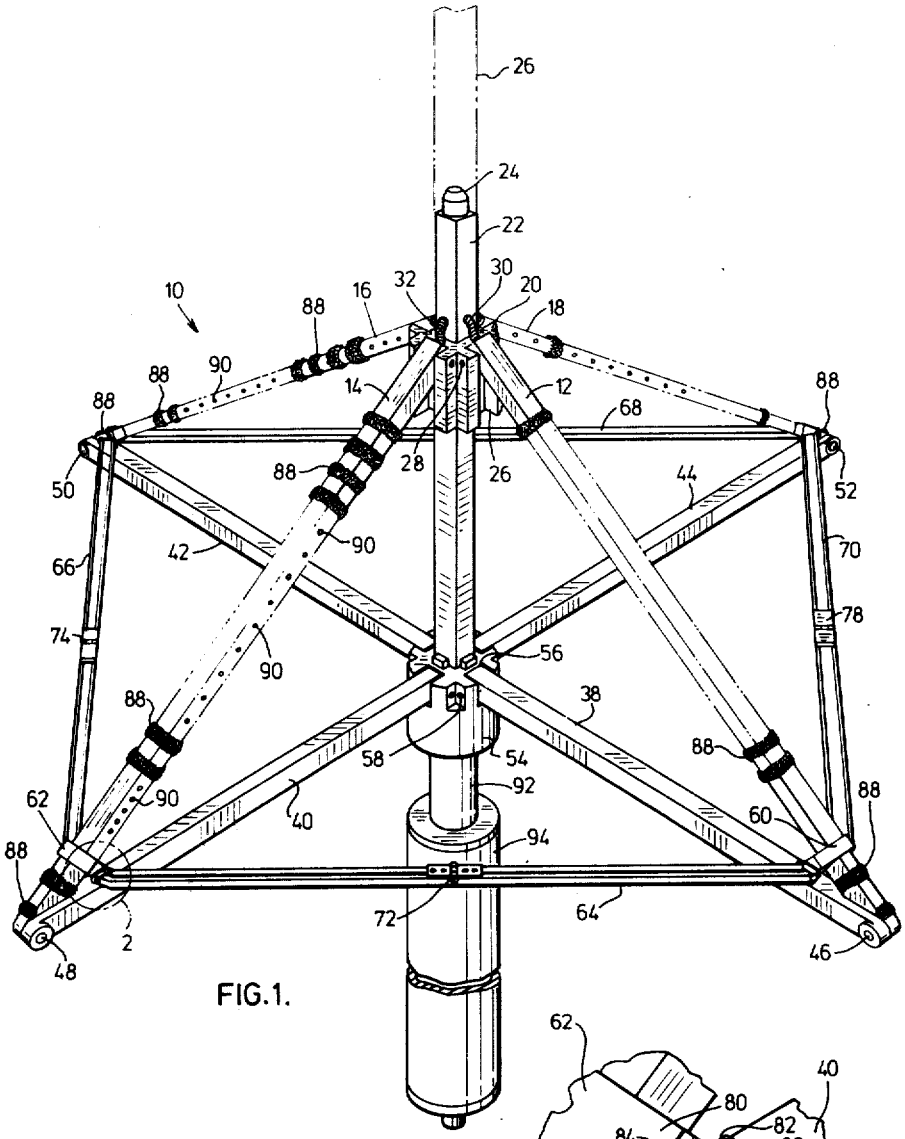
FIG. 1 is a diagrammatic perspective view of one version of a mining tool or hole expanding tool according to the present invention, in its radially expanded position.

With reference to FIG. 1, the mining tool according to the present invention, generally designated 10, has an "umbrella-type" action whereby it can be moved from a radially contracted position to a radially expanded position, by up and down movement of a lower sliding block on a central shaft, the mining arms or booms of the tool being hingedly connected to the lower sliding block and to a fixed block, and having a hinge joint near the middle of their length. Specifically, the tool 10 has four mining booms 12, 14, 16, 18 distributed equidistantly around the tool 10, and hingedly connected to a fixed top head 20. The top head 20 is releasably secured to a square section kelly 22. The top end of kelly 22 is provided with a tool joint 24, for securing it to a long kelly section and a drill string 26, shown in broken lines, which can extend upwardly through the pilot hole in practice, to power sources and fluid supply sources above ground. The top head 20 is provided with four vertically extending channels such as 26, sized so as to receive therein the ends of the respective mining boom 12 etc., in a pivotal manner. Each channel 26 etc. is provided with a pivot pin such as 28 extending transversely through the side structures of the channels 26 and ends of the respective mining booms 12 etc., for pivotal mounting of the booms 26 etc. therein The interior of kelly 22 and joint 24 is hollow, to provide fluid communication with the ground surface. Each mining boom 12, 14 etc. is connected with the hollow interior of the kelly 22 by means of flexible braid covered high pressure hoses 30, 32 etc. By means of hoses 30, 32, fluid can be supplied from the kelly 22 to mining booms 12, 14, 16, 18.

In the radially expanded position of the tool 10 shown in FIG. 1, the four mining booms 12, 14, 16, 18 are disposed in a pyramid configuration, around the kelly 22 at the centre, the kelly 22 extending a substantial distance below top head 20. At its radially outer lower extremity, each mining boom 12 etc. is hingedly connected to a respective radially outwardly extending spoke 38, 40, 42, 44 by means of respective pivot pins 46, 48, 50, 52. At their inner ends, the spokes 38, 40, 42 and 44 are pivotally mounted on a slidable bottom head 54 which is slidable upon the square section kelly 22 for up and down movement. To receive the inner ends of spokes 38, 40, 42 and 44, the upper part of bottom head 54 is provided with appropriately sized channels such as 56, and pivot pins such as 58 extending through aligned apertures in the side structures of channels 56 and in the ends of spokes 38 etc.

Close to its radially outer end, each mining boom 12, 14 etc. is provided with an integral mounting formation such as 60 or 62, to which are hingedly connected the ends of two hinged struts. Thus there are four such hinged struts 64, 66, 68, 70, which, in the radially expanded position of the tool 10, substantially define the four sides of the base of the pyramid configuration, extending between adjacent ones of the spokes 38, 40, 42, 44. The struts are of shallow channel configuration, and are provided with respective hinges 72, 74, 76, 78, at the approximate midpoint of their lengths.

Figure 2:
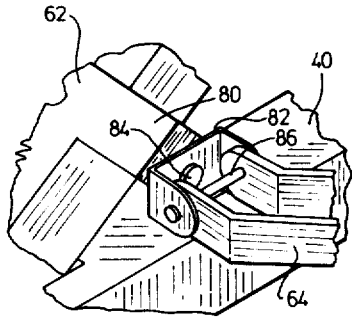
FIG. 2 is a detail of a corner joint of the tool shown in FIG. 1.

The detail of the hinge connection of a strut 64 to a mounting formation 62 of the mining boom 14 is shown in FIG. 2. The integral mounting formation 62 has a protrusion 80 extending towards the strut 64, to the end face of which is pivotally connected the base of a U-bracket 82, by means of a pivot pin 84. A second pivot pin 86 extends through aligned apertures in the side walls of U-bracket 82 and in the side walls of channel shaped strut 64. Thus strut 64 is hingedly connected to the mining boom 14 for pivotal movement with respect thereto about two mutually perpendicular axes. An essentially similar pivotal connection is provided on the other side of boom 14 to connect strut 66 to mining boom 14 for hinge movement about two mutually perpendicular axes.

Each mining arm or boom 12, 14 etc. is provided on its surface with sets of cutting teeth 88 at intervals along its length, and down at its radial extremities to come in contact with a mine and mechanically grind the deposit as the tool rotates in its expanded condition. The arms also have jets 90 in their rotationally trailing faces, for issue of high pressure mining fluid to cause separation and extraction of the mined material, and impart rotational thrust to the tool 10. The jets are directed upwardly from the rear face of the mining boom.

The lower sliding block 54 is mounted on a piston 92 slidably received in a cylinder 94 supplied with fluid pressure from about ground, to raise and lower piston 92 therein and hence raise and lower block 54 to radially expand and contract the arms 12 etc.

Figure 3:
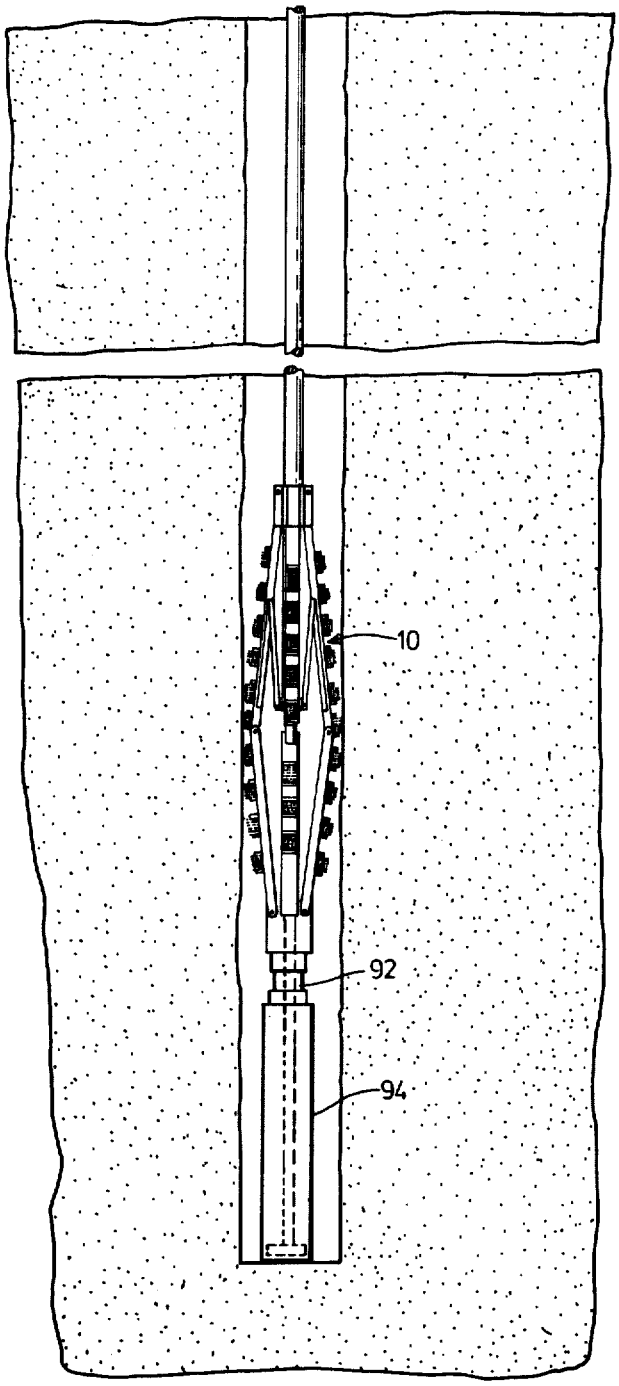
FIG. 3 is a diagrammatic part sectional view showing the tool of FIG. 1 in a radially contracted position in a bored pilot hole.
Figure 4:
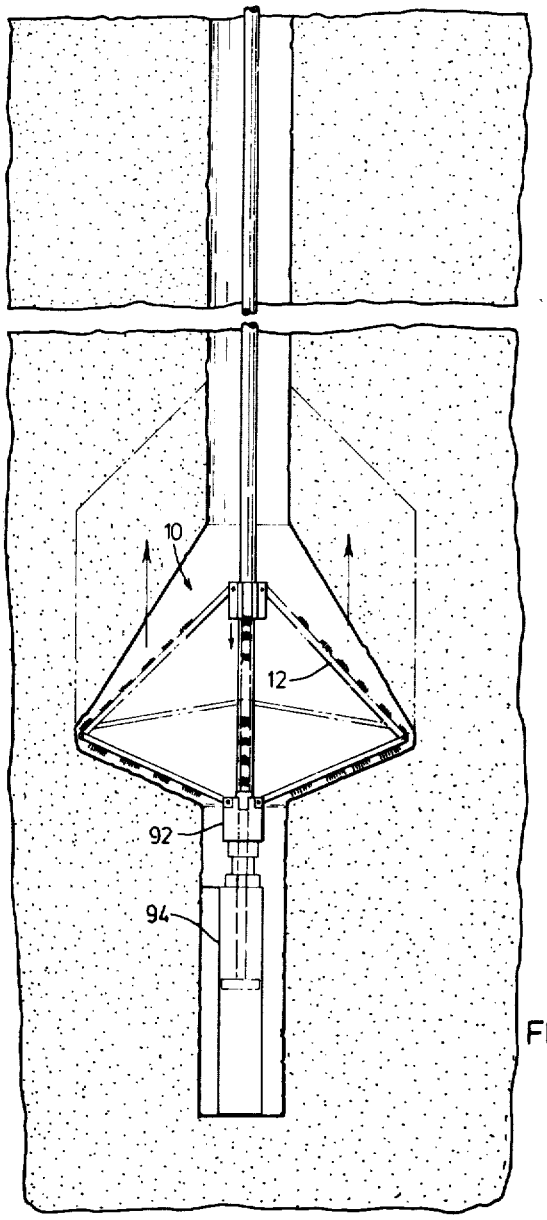
FIG. 4 is a view similar to FIG. 3 but showing the tool in its radially expanded position.

FIG. 3 shows the tool 10 in a radially contracted position inside a narrow (e.g. 30 inch diameter) pilot hole prior to radial expansion and mining. It will be seen that the cylinder starts at the bottom of the hole. When pressure is supplied to cylinder 94, piston 92 rises and arms 12 etc. expand radially. With the tool 10 rotating, this causes the teeth 88 and jets 90 to mine the deposit and cut a conical shaped cavity as shown in FIG. 4. Then the tool, including the cylinder 94 and piston 92, is gradually raised with continued rotation to mine out the expanded hole from top to bottom, with down hole in situ separation as previously described.

Figure 5:
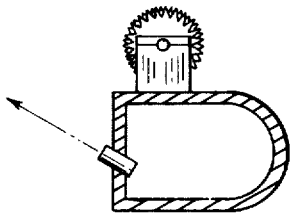
FIG. 5 is a cross sectional view of a mining arm or boom of a tool arm of the invention.

FIG. 5 shows in section an alternative and preferred mining arm, which has a generally square, hollow section but a rotationally leading edge 100 of conversely curved configuration for added strength. The trailing edge is provided with jets such as 102, directed upwardly. On the top edge, cutter wheels 104 are mounted. Typically, the arm is about 10 inches square, with 2 inch wall thicknesses. The arm is provided along its length with alternating 2 foot sections of cutter wheels and jets, the jets having larger diameter nearer the central shaft.

The process and apparatus of the invention is also useful for mining coal, as previously described, as well as various other mineral ores. In the case of coal, no substantial amount of in situ separation of coal from other materials is necessary, although this does beneficially occur down hole. The coal obtained according to the present invention is ground to powder down hole by the action of the jets and the cutter wheels. It is obtained as a powdered slurry or emulsion, at the surface, being forced up the mining boom by the supply of high pressure mining fluids in large volumes down hole through the mining took, in essentially the same manner as the oil/bitumen emulsion is obtained from the tar sand deposits, and the oil emulsion is obtained from oil deposits, according to the invention.

According to the process and apparatus of the present invention, often coal deposits are covered by a depth of overburden too thick for economic strip mining even to recover 50–1,000 feet depth of the deposits of top quality anthracite, and the apparatus and process according to the present invention finds utility in such deposits. Likewise, the overburden may be composed of unstable clays, shales and the like, making timbered shaft or pillar and room mining impossible. The system according to the present invention can then be advantageously used, for the recovery of top quality coal from such deposits.

The apparatus according to the invention may also be used in coal mining by air drilling, supplying air from conventional mine-air blowers down the rotary apparatus, thus reducing or even eliminating the requirement for down-hole water.

With respect to exhausted oil reservoirs, which may contain 50 to 70% of the original oil deposit as "dead oil", the expanded hole reservoir becomes a worthwhile means of obtaining further oil after conventional mining processes have exhausted their potential.

The apparatus according to the invention has a variety of other uses in the mining field. For example, it can be used as a centrifuging apparatus, moving downwardly through an underground cavity previously bored out by this or a similar tool in an upward direction, as hardware for standard tertiary recovery drilling.

Another important use of the apparatus of the invention is in preparation of underground silos, e.g. for disposal of nuclear wastes. After producing a cavern of acceptable size by the process and apparatus of the invention, concrete may be poured down hole to produce a solid concrete base for the cavern. A casing may be placed therein, either of collapsible form or having outer release surfaces (wax paper, PTFE, etc.) to form an annulus against the side walls into which concrete may be poured. Then after the concrete has been set, the casing can be removed to leave a concrete walled underground storage silo.

I claim:

1. A process for in situ extraction of bitumen values from subterranean tar sand deposits, which comprises:

drilling a pilot hole of relatively narrow diameter from the ground surface, through the overburden and the tar sand deposit and a distance of 2–2½ times the thickness of the tar sand deposit into the sub-tar sand formation located beneath the tar sand deposit;

enlarging the pilot hole below the tar sand formation to form a sub-tar sand cavern and extracting the mined materials from said sub-tar sand tar cavern to the ground surface through said pilot hole;

filling the sub-tar sand cavern with aqueous liquid;

enlarging the pilot hole radially in the tar sand deposit by treating the tar sand deposit with circulating high pressure jets of heated mining fluid comprising a mixture of water and normally gaseous hydrocarbons, the temperature difference between the in situ deposit and the mining fluid immediately prior to issue from the jets being at least 60° F., to cause breakup of the tar sand deposit and interaction of the bitumen portion of said deposit with gases of the mining fluid, and to form a tar sand cavern;

agitating the liquid slurry of tar sand and mining fluid formed in the tar sand cavern to wash and cause downward settling of the sand component of the tar sand;

and upwardly displacing the separated oil component to the ground surface.

2. The process of claim 1 wherein the pilot hole is radially enlarged in the tar sand deposit by combination of hydraulic mining by said high pressure jets and mechanical grinding of the deposit in the vicinity of application thereto of said circulating jets.

3. The process of claim 2, wherein said high pressure jets and said mechanical grinding are applied to the tar sand deposit by means of rotary arms carrying jets and mechanical mining teeth, adapted to rotate down hole adjacent to or in contact with the mining surface of the deposit.

4. The process of claim 2, wherein the heated mining fluid comprises a mixture of water and normally gaseous hydrocarbon.

5. The process of claim 4, wherein the heated mining fluid has a pH from 7.5 to 9.5.

6. The process of claim 4, wherein the heated mining fluid is employed at a temperature from 105° F. to 200° F.

7. The process of claim 3, wherein the heated mining fluid is supplied to jets at pressures from about 1000–5000 psi, to issue therefrom and impinge upon the tar sand deposit at high speed.

* * * * *